US008403158B2

(12) United States Patent
Itzek

(10) Patent No.: US 8,403,158 B2
(45) Date of Patent: Mar. 26, 2013

(54) FEEDING BOTTLE

(75) Inventor: Eckhard Itzek, Gyhum-Nartum (DE)

(73) Assignee: MAPA GmbH, Zeven (DE)

( * ) Notice: Subject to any disclaimer, the term of this patent is extended or adjusted under 35 U.S.C. 154(b) by 15 days.

(21) Appl. No.: 13/003,683

(22) PCT Filed: Jul. 10, 2009

(86) PCT No.: PCT/EP2009/005044
§ 371 (c)(1),
(2), (4) Date: Mar. 31, 2011

(87) PCT Pub. No.: WO2010/006739
PCT Pub. Date: Jan. 21, 2010

(65) Prior Publication Data

US 2011/0266246 A1 Nov. 3, 2011

(30) Foreign Application Priority Data

Jul. 12, 2008 (DE) ..... 10 2008 032 905

(51) Int. Cl.
*A61J 11/04* (2006.01)
*A61J 9/00* (2006.01)

(52) U.S. Cl. ..... 215/11.6; 215/11.1

(58) Field of Classification Search ..... 215/11.1, 215/11.6; 604/234, 236
See application file for complete search history.

(56) References Cited

U.S. PATENT DOCUMENTS

| | | | | | |
|---|---|---|---|---|---|
| 1,623,544 | A * | 4/1927 | Kushner | 215/11.6 |
| 2,986,296 | A * | 5/1961 | Bannister et al. | 215/11.1 |
| 4,505,398 | A * | 3/1985 | Kesselring | 215/11.5 |
| 4,703,863 | A * | 11/1987 | Kohus | 215/11.1 |
| 4,834,099 | A * | 5/1989 | Schrooten | 215/11.1 |
| D349,769 | S * | 8/1994 | Green | D24/197 |
| 6,032,810 | A * | 3/2000 | Meyers et al. | 215/11.1 |
| 6,161,710 | A * | 12/2000 | Dieringer et al. | 215/11.4 |
| 6,286,697 | B1 * | 9/2001 | Gasparini | 215/11.5 |
| 2006/0006128 | A1 * | 1/2006 | Resendiz Sanudo | 215/11.6 |
| 2006/0060551 | A1 * | 3/2006 | Hong | 215/11.1 |
| 2006/0144810 | A1 * | 7/2006 | Mallet | 215/11.1 |
| 2008/0083692 | A1 * | 4/2008 | Strickler et al. | 215/11.6 |

FOREIGN PATENT DOCUMENTS

| | | | |
|---|---|---|---|
| CH | 261501 | A | 5/1949 |
| DE | 3137248 | A1 | 6/1982 |
| DE | 3337248 | A1 | 11/1984 |
| DE | 92144438 | U1 | 2/1993 |
| DE | 4133064 | A1 * | 4/1993 |
| DE | 9318699 | U1 | 1/1994 |

(Continued)

*Primary Examiner* — Sue Weaver
(74) *Attorney, Agent, or Firm* — Vidas, Arrett & Steinkraus, P.A.

(57) ABSTRACT

A feeding bottle comprising a bottle, which has an opening and an external thread surrounding the opening, a teat, which has a nipple carrier with a fastening edge and, on the nipple carrier, a teat nipple with a drinking hole in a side surface, a ring nut, which has an internal thread for screwing onto the external thread and means for connecting with the fastening edge of the teat, in order to keep the teat from the bottle opening, and a covering cap, which can be placed on the teat and, whereas the covering cap in its placed position presses with the inside of its side wall against the side surface of the teat nipple having the drinking hole and form a seal and, with the inside of its bottom, presses against an opposite side surface of the teat nipple.

12 Claims, 3 Drawing Sheets

FOREIGN PATENT DOCUMENTS

Figure 1:
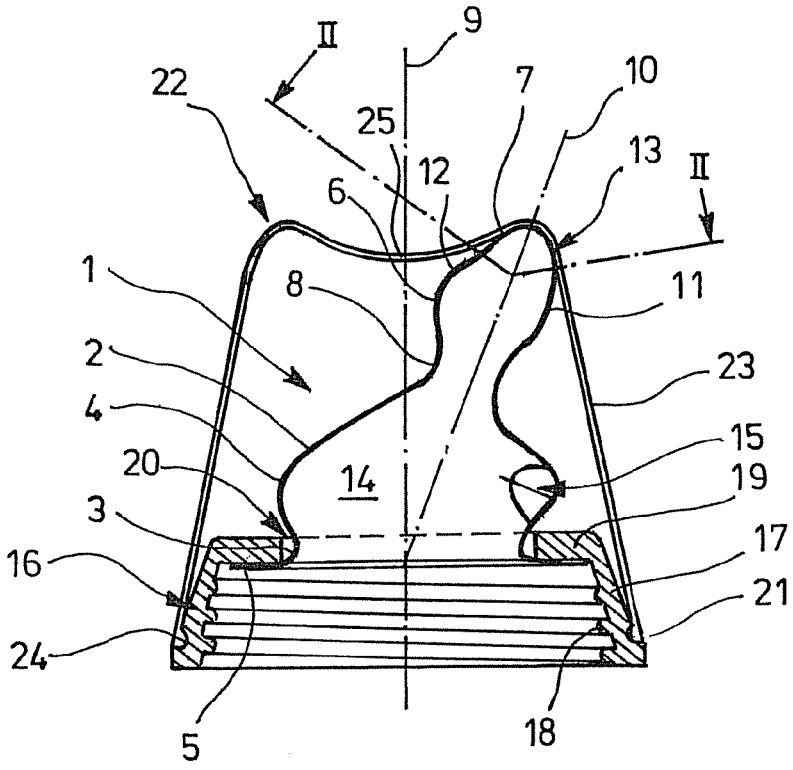

| | | | |
|---|---|---|---|
| DE | 19739911 | A1 | 6/1998 |
| DE | 20009823 | U1 | 8/2000 |
| DE | 20008003808 | U1 | 8/2009 |
| EP | 0527094 | A1 | 2/1993 |
| WO | 98/15463 | A1 | 4/1998 |
| WO | 99/03442 | A1 | 1/1999 |

* cited by examiner

FEEDING BOTTLE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to a feeding bottle with a bottle, a teat, a ring nut for fastening the teat to the edge of the opening of the bottle and a covering cap, which is to be placed on the ring nut.

Feeding bottles are used to provide milk and other liquid food especially to children. Known feeding bottles have a bottle and a teat, which can be fixed by means of a ring nut to an external thread of the bottle, which runs around the opening of the bottle. A covering cap can be placed on the ring nut. A washer or an edge of the teat can be clamped between the ring nut and the opening edge of the bottle, forming a seal. Such means prevent food running out unintentionally. Such a feeding bottle is described in the DE 33 37 248 A1.

The CH 261 501 A, U.S. Pat. No. 5,419,445 A and U.S. Pat. No. 2,579,194 A disclose feeding bottles with teats and covering caps which, when placed in position, are seated with the inside of their bottom on the drinking hole in the center of the teat nipple. The bottom of the cap is curved concavely at the inside and the teat nipple with the central drinking hole lies against this concave curvature forming a seal.

The WO 99/03442 A1 discloses a covering cap, which is fitted to the outer shape of the teat, in order to avoid any space between the covering cap and the teat. At the top, the inside of the covering cap seals off a drinking hole at the crest of the teat, in order to prevent milk emerging. For withdrawing nourishment, a portion of the covering cap can be detached from its body by tearing open a tear-off strip. This covering is suitable only for a single use. The covering cap, once taken off, cannot be put back in place again to form a seal.

The EP 0 527 094 A1 discloses a feeding bottle with a cap, which can be snapped into a groove on the outside of a ring nut. The cap contains a flexible membrane, which can be connected permanently with a sleeve disposed at the bottom of the cap. The membrane is elastic and seals off the drinking hole of the teat, when the cap is placed on the ring nut. The cap is costly and difficult to clean. For orthodontically shaped teats, for which the drinking hole is disposed in a side surface of the head part of the teat nipple and aligned at an acute angle to the axis of the teat, the membrane, after it is arched to some extent, fits against the drinking hole and seals it off. The contacting pressure of the membrane against the opening edge of the teat is consequently relatively slight, so that there may be leaks.

The DE 92 14 438U1 and DE 93 18 699 U1 disclose a baby bottle with a covering cap, the height of which is less than the height of the teat. Consequently, the covering cap presses with the bottom of a chamber against the drinking holes of the teat, sealing them off. In so doing, the orthodontically shaped teat is deformed appreciably, so that, at the end of the deformation, a drinking hole, disposed in a side of the teat, inclined to the central axis, lies with its edge against the bottom of the cap, forming a seal. The sealing forces, which arise here, are relatively slight, so that there may be leaks.

The DE 200 09 873 U1 discloses a baby bottle with a flexible teat, which has a compression section around the drinking hole. A flexible cap has an engagement section, which is formed at its upper inside and the shape of which corresponds to that of the compression section. The engagement section can be pressed onto the compression section so that the latter can be sunk by a specified amount, when the cap is placed on the holding ring, as a result of which the liquid, contained in the container, is prevented effectively from running out through the drinking hole of the teat. This construction is not suitable for an orthodontically shaped teat with a drinking hole in a side surface of the teat nipple inclined to the central axis.

The WO 98/15463 A1 discloses a feeding bottle with a teat and a covering cap. At the bottom, the covering cap has a protrusion, which projects downward and seals the drinking hole at the crest of the teat nipple. This construction is unsuitable for an orthodontic teat with a drinking hole in an inclined side surface of the teat nipple.

BRIEF DESCRIPTION OF THE INVENTION

Starting out from the above, it is an object of the invention to make available a feeding bottle, which seals off an orthodontically shaped teat more simply and more reliably.

The inventive feeding bottle, especially for feeding infants and small children, comprises

- a bottle, which has an opening and an external thread surrounding the opening,
- a teat, which has a nipple carrier with a fastening edge and, on the nipple carrier, a teat nipple with a drinking hole in a side surface,
- a ring nut, which has an internal thread for screwing onto the external thread and means for connecting with the fastening edge of the teat, in order to keep the teat from the bottle opening, and
- a covering cap, which can be placed on the teat and, whereas the covering cap in its placed position, presses with the inside of its side wall against the side surface of the teat nipple having the drinking hole and forms a seal and, with the inside of its bottom, presses against an opposite side surface of the teat nipple, which is aligned at an acute angle to the central axis of the fastening edge.

In the case of the inventive feeding bottle, the teat nipple of the teat is held at its free end, remote from the fastening edge, in the corner region between the side wall and the bottom of the covering cap. The side wall lies in contact here with the side surface of the teat nipple, which has the drinking hole. The bottom lies in contact with the opposite side surface of the teat nipple. Consequently, the force, introduced by the side wall of the covering cap into the side surface with the drinking hole, is supported over the opposite side surface of the teat nipple at the bottom of the covering cap. Accordingly, the side wall is in contact with the edge region of the drinking hole with a particularly high contacting force, so that there is a very good seal between the edge region and the side wall. The alignment of the teat nipple on the corner region between the side wall and the bottom of the covering cap can be attained owing to the fact that the teat has a teat nipple, which is aligned at an acute angle to the central axis of the fastening edge of the nipple carrier already when not under load. In the case of a teat with a teat nipple disposed on the central axis in the unloaded state, it can be achieved owing to the fact that the teat nipple is forced through the covering cap, which has been put in place, in an acutely angled direction to the fastening wall. Because the teat nipple is inclined, the free end of the teat nipple is forced between the bottom and the side wall when the covering cap is put in place, and the drinking hole is sealed securely.

The drinking hole may be constructed as a circular hole or as a slot. Preferably, the teat has only a single drinking hole. It may, however, also have several drinking holes, which are sealed simultaneously in the manner described.

The free end of the teat nipple may be configured in various ways. According to one configuration, the teat nipple is curved towards the outside at the side surface, having the drinking hole, with a relatively large or small radius of curvature and is flat or slightly curved concavely with a large radius of curvature on the opposite outer side and, in between, has a relatively small transition radius. According to a further configuration, the drinking hole is disposed in a side surface of the teat nipple facing away from the central axis of the fastening edge.

According to a further design, which leads to a particularly well sealed abutment of the covering cup on the drinking hole, the covering cup has a conical outer wall and/or a cup-shaped bottom. The cup-shaped bottom is preferably curved inward, that is, into the interior of the covering cup. Preferably, the transition between the bottom and the side wall of the covering cup is rounded. The sealing is particularly effective if this covering cap interacts with a teat nipple configured at the free end, as described above.

The covering cap is held detachably at the ring nut. For example, the covering cap and the ring nut can have mutually matching bearing areas, which make a clamping seat or a frictional seat of the covering cap on the ring nut possible. According to one design, the ring nut and the covering cap have interacting locking elements for locking the covering cap to the ring nut.

According to a further design, which leads to a particularly secure sealing of the drinking hole at the covering cap, the hole access of the drinking hole is aligned perpendicularly to the side wall of the covering cap. Consequently, the edge region of the drinking hole is in contact with the side wall of the covering cap, forming a uniform seal.

According to one design, the side surface, having the drinking hole, has a smaller radius of curvature than the inside of the side wall contacting thereon and/or the opposite side surface has a larger radius of curvature than the inside of the bottom pressing thereon. This is true for the radii of curvature in at least one intersecting plane through the contact regions between the teat nipple and the covering cap. For example, this is the case at least for the radii of curvature in one vertical intersecting plane. Preferably, this is the case for radii of curvature in several intersecting planes and, furthermore, for the radii of curvature in all intersecting planes. By means of this, a two-dimensional pressing around the drinking hole is produced and the counter force is selectively introduced into the opposite side surface of the teat.

The nipple carrier of the teat can be constructed in various ways. According to one design, it is bellows shaped, in that, adjoining to the fastening wall, it has, for example, a waist and, adjoining thereon, a bulge. The teat may also have several consecutive waists and bulges. According to another design, the nipple carrier is hood-shaped ore bell-shaped, so that, starting from the nipple carrier, it tapers gradually up to a crest on which the teat nipple is seated.

According to a further design, the nipple carrier has a groove running around the central axis of the fastening edge. An increased flexibility can be provided here especially to a hood-shaped nipple carrier.

According to a further design, the teat has an integrated security thread, which extends from the fastening edge up to the free end of the teat nipple. By these means, the teat is provided with increased strength. Teats with security threads are particularly advantageous when the teat is constructed from silicone rubber, since the security thread can prevent a portion of the teat being torn off.

According to a further design, the security thread extends to the fastening edge up to the drinking hole. The security thread may be connected positively and/or not positively and/or adhesionally with the teat. A positive connection is possible, for example, by embedding the security thread partly or completely in the material of the teat. A completely embedded security thread is surrounded on all sides by the material of the teat. A non-positive connection can be produced by pressing the security thread into a groove of the teat. An adhesional connection between the security thread and the teat, which can be achieved by cross-linking or melting the contact regions between the security thread and the teat, is preferred. The gluing of the security thread to the teat is a further possibility for producing an adhesional connection. Preferably, the teat consists of a plastic material, which can be melted together with or cross-linked with the security thread and/or the ring nut. Preferably, the teat is produced optionally together with the security thread or the ring nut in a multi-component injection molding process.

Basically, the teat and the ring nut, may be constructed separately from one another. In the case of one design of this embodiment, the ring nut has a ring flange, which protrudes inward, for pressing the fastening edge against an opening edge of the bottle opening and a central insertion opening for inserting the teat nipple and the nipple carrier of the teat. In this design, the teat is clamped at the fastening edge between the ring nut and the opening edge of the bottle.

According another design, the teat is connected firmly at the fastening edge with the ring nut. A teat, connected in one piece with the ring nut, can be produced particularly in a multi-component injection molding process. The teat may be connected positively and/or not positively and/or adhesionally with the ring nut. A positive connection can be achieved by a positive meshing of the teat and the ring nut. A non-positive connection between the teat and the ring nut can be achieved, for example, in that the teat and the ring nut are produced from different plastics, which, after the injection molding, have different shrinkages, the part with the higher shrinkage surrounding at least partially the part with the lower shrinkage, so that it clamps the inner part. Furthermore, the teat and the ring nut can be connected adhesionally with one another in that the plastic of the teat and the plastic of the ring nut are selected so that they melt or cross-link with one another in the contact areas. Furthermore, adhesional connection by gluing is possible. In this way, a very firm connection between the teat and the ring nut can be produced.

According to a further advantageous design, the security thread is connected firmly with the ring nut, so that the security thread is fixed to the ring nut. Advantageously, the teat is produced from a soft or soft elastic material and the ring nut and the bottle from a stiffer material.

Different soft elastic materials come into consideration for the teat. For example, a natural or synthetic rubber or a different elastomer can be used. According to a further design, the soft elastic plastic is a thermoplastic elastomer. Advantageously, thermoplastic elastomers can be processed by injection molding. Thermoplastic elastomers may be multi-phase plastics, which have rubber elastic, moldable molecular regions, in which the regions of amorphous thermoplastic materials are incorporated. They can therefore be molded thermoplastically, and, at the same time, have the desired elastic properties.

The security thread may be constructed in various ways. For example, it is a textile thread of several fibers, which are connected or twisted with one another, or a tape or a strip. Preferably, the tape or strip is a sheet of plastic. A firm connection between the security thread and the ring nut may be positive and/or not positive and/or adhesive. For a positive connection, the security thread can be anchored, for example, with thickened ends in the material of the ring nut. For a non-positive connection, the ends of the security thread can be pressed into receptacles in the ring nut. For an adhesive connection, it may be connected at least at one end by cross-linking and/or by gluing with the material of the ring nut.

Preferably, the security thread consists of a plastic. In particular, the security thread may consist of the same plastic as the ring nut. This is particularly preferred if the security thread is constructed in one piece with the ring nut or connected with the latter adhesionally. Preferably, the security thread consists of polypropylene.

Preferably, the teat is provided additionally with a valve, such as a slot valve, through which air can flow in order to equalize pressure.

The invention is described in greater detail in the following by means of attached drawings of examples, in which

BRIEF DESCRIPTION OF THE SEVERAL VIEW OF THE DRAWINGS

Figure 2:
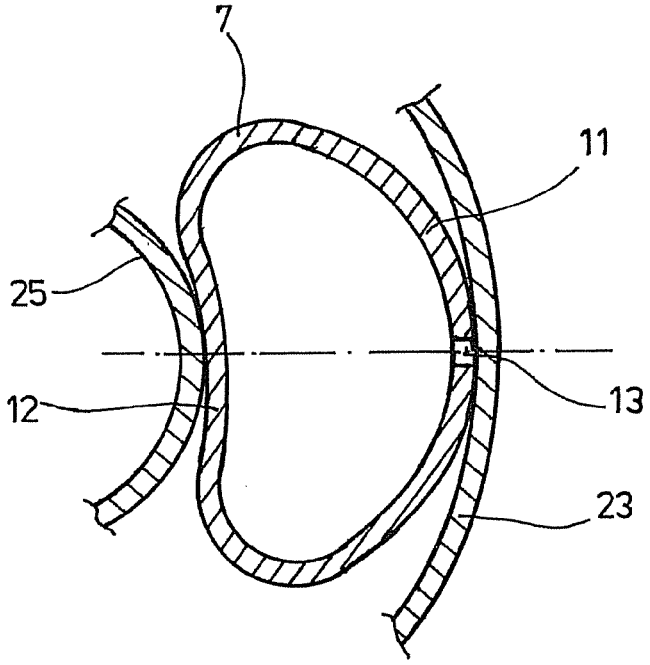
Figure 3:
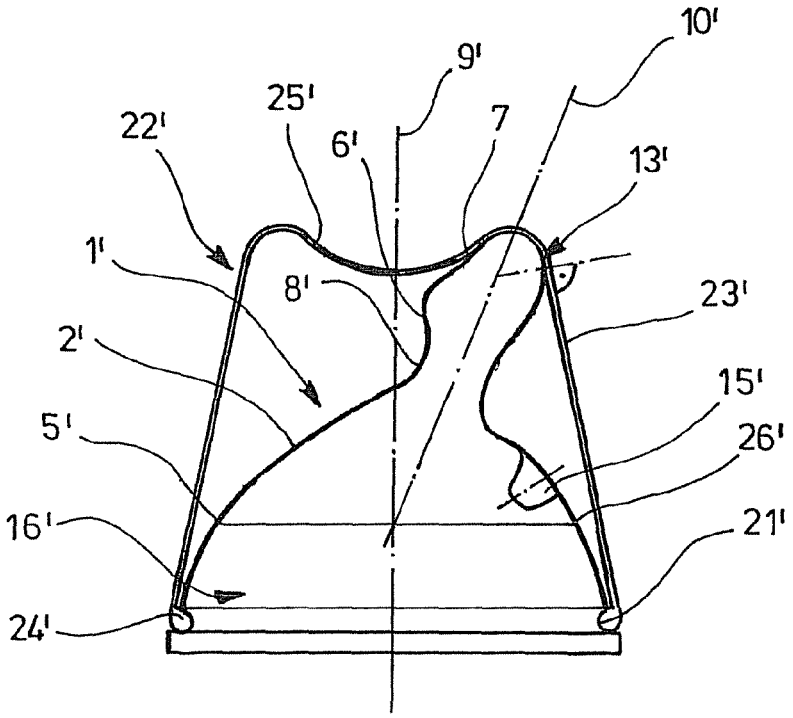
Figure 4:
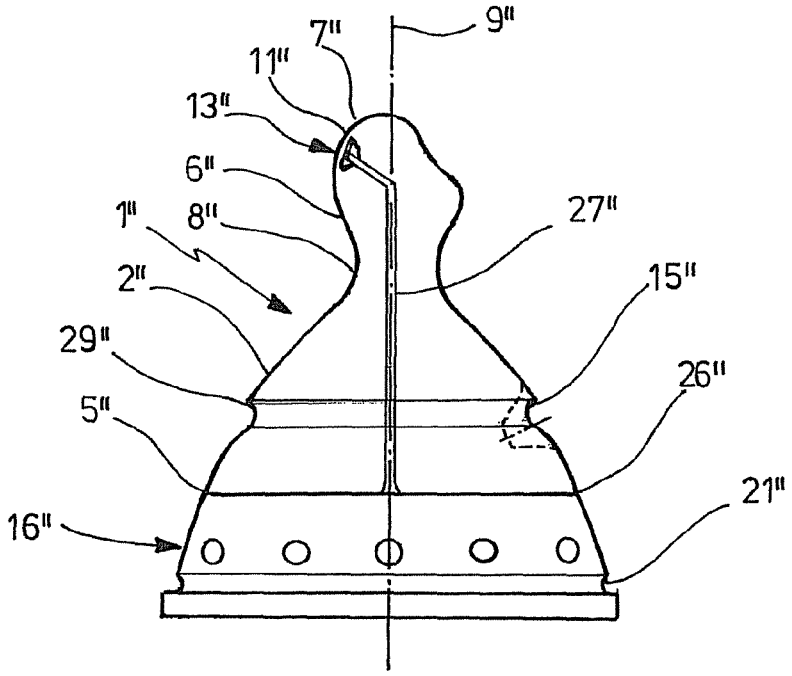
Figure 5:
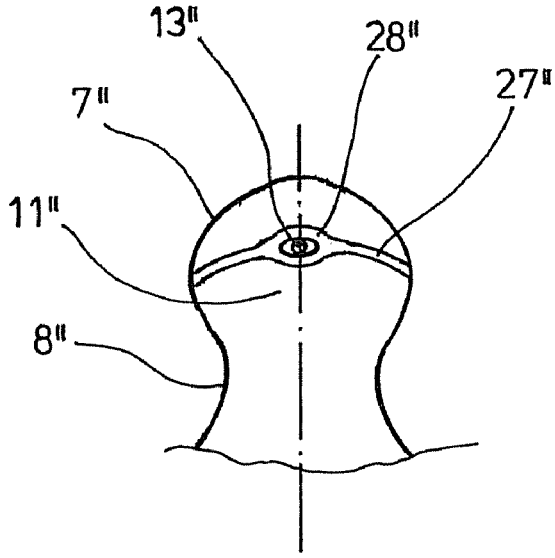
Figure 6:
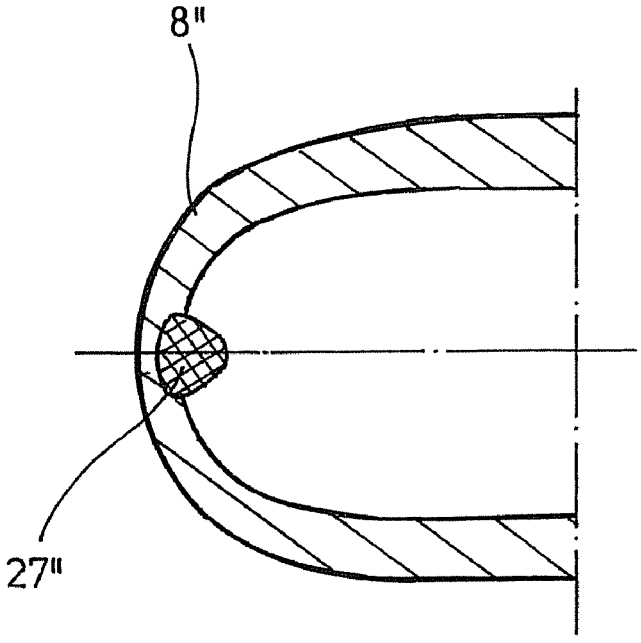

FIG. 1 shows an orthodontic teat with a bellows-shaped nipple carrier and a teat nipple at an in-place ring nut aligned at an acute angle to the central axis, and an in-place covering cap in a vertical plane, FIG. 2 shows a teat and covering cap in an enlarged partial section in the vertical direction along the line II-II of FIG. 1, FIG. 3 shows an orthodontic teat with a bellows-shaped nipple carrier and a teat nipple, which is aligned acutely to the central axis of the fastening edge, to which a ring nut is connected at one side, and a covering cap, snapped on, in a vertical section, FIG. 4 shows an orthodontic teat with a hood-shaped nipple carrier with a full perimeter groove and a security thread and a teat nipple, aligned on the central axis of the fastening edge and connected in one part with the ring nut, in side view, FIG. 5 shows the same teat in a detailed view of the teat nipple, surrounding the drinking hole and FIG. 6 shows the neck of the teat nipple of the same teat on an enlarged scale, partly in a horizontal section.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated In the following explanation of different examples, corresponding parts are provided with the same reference numbers, the reference numbers of further examples being marked with a prime or a double prime.

The arrangement of FIG. 1 has a teat 1 with a bellows-shaped nipple carrier 2, a waist 3, a bulge 4 and a circular disc-shaped fastening edge 5. At the top, the nipple carrier 2 carries a teat nipple 6, which has a nipple head 7 and a somewhat constricted neck 8. The teat nipple 6 is inclined at an acute angle to the central axis 9 of the fastening edge 5, the axis of inclination being labeled 10. The teat nipple 6 has this inclination with respect to the central axis 9 when in the not loaded state.

The inclined alignment of the teat nipple 6 may have advantages when providing food.

The teat nipple 6 is shaped orthodontically. A side surface 11 of the nipple head 7, which is facing away from the central axis 9, is curved slightly convexly or has a large radius of curvature. A side surface 12 of the nipple head 7, facing the central axis 9, is curved slightly concavely. The transition regions between the two aforementioned side surfaces 11, 12 are curved more convexly or have a smaller radius of curvature then the side surface 11 facing away.

In the side surface 11 facing away, there is a drinking hole 13, which connects a cavity 14 in the interior of the teat 1 with the surroundings.

At one side, the nipple carrier 2 has a valve 15, through which the cavity 14 can be connected with the surroundings. The valve 15 opens up when there is a negative pressure in the cavity 14. Preferably, it is constructed as a slot valve.

Furthermore, the arrangement has a ring nut 16 with a slightly conical casing 17 and an internal thread 18 for screwing it onto a corresponding external thread of a bottle (not shown). The ring nut 16 may be provided with a standard thread, so that it fits on common bottles.

At the top at the casing 17, the ring nut 16 has a circular disc-shaped annular flange 19, which protrudes inward. The annular flange 19 forms the boundary of an insertion opening 20. The teat 1 with the teat nipple 6 and the nipple carrier 2 are inserted into the insertion opening 20, the waist 3 being disposed precisely within the insertion opening 20. Moreover, the fastening edge 5 is below the annular flange 19, so that it is pressed by the annular flange 19 against an opening edge of a bottle opening, when the ring nut 16 is screwed onto the external thread of the bottle.

The ring nut 16 is provided at its external extent with an encircling locking groove 21. Furthermore, the arrangement comprises a covering cap 22, which has a slightly conical side wall 23, which, at the lower edge, has an inwardly protruding locking bead 24, which can be snapped into the locking groove 21 of the ring nut 16.

The covering cap 22 has an inwardly arched, cup-shaped bottom 25. The transition region of the cup-shaped bottom 25 is rounded off in the direction of the conical side wall 23. The cup-shaped bottom is symmetrical with respect to the central axis 9. The rounding off runs around the central axis 9.

When the covering cap 22 is snapped onto the ring nut 16, the cup-shaped bottom 25 presses against the side surface 12 of the nipple head 7, facing the central axis 9, and the side wall 23 presses against the side surface 11, which faces away. Accordingly, the nipple head 7 is forced between the bottom 25 and the side wall 23. Moreover, the nipple head 7 is held in the crest region in the rounded off section between the cup-shaped bottom 25 and the conical side wall 23 of the covering cap 22. According to FIG. 1, the inner contour of the rounded off section of the covering cap 22 and the outer contour of the crest region of the nipple head 7 approximately match one another, so that these regions lie in contact with one another. The drinking hole 13 is disposed in the nipple head 7 in such a manner, that it is aligned approximately perpendicularly to the side wall 23 and an edge region is pressed against the side wall 23 around the drinking hole 13 so as to form a seal.

According to FIG. 2, the side surface 11 at the drinking hole 13 has a smaller radius of curvature in the vertically intersecting plane than the side wall 23, in order to produce a defined pressing surface around the drinking hole 13. Furthermore, the side surface 12 has a larger radius of curvature in the region of contact with the bottom 25 than does the bottom 25, in order to ensure a defined pressure on the side surface 12 opposite the drinking hole 13.

Accordingly, the covering cap 22 traps the geometry of the nipple head 7 and presses it into the upper corner of the covering cap 22 in order to form a seal.

The construction of FIG. 3 differs from the aforementioned one especially in that the teat 1' is integrally molded to the ring nut 16'. The fastening edge 5' of the teat 1 is connected with the upper edge 26' of the ring nut 16'. The ring nut 16' consists, for example, of polypropylene and the teat 1' consists of a thermoplastic elastomer {for example, one based on polypropylene), which is cross-linked with the material of the ring nut 16'

Furthermore, the nipple carrier 2' of the teat 1', which is constructed in one piece with the ring nut 16', has a hood-like shape.

The teat nipple 6' and the drinking hole 13' as well as the covering cap 22' are constructed as for the preceding example. In particular, the teat nipple 6' is inclined to the central axis 9' when the teat 1 is not under a load.

For this arrangement also, an impression is produced at the corner between the bottom 25 and the side wall 23 by snapping the covering cap 22' onto the nipple head 7' and the drinking hole 13 is sealed.

The example of FIGS. 4 to 6 differs from the example of FIG. 2 especially owing to the fact that the teat 1" of a soft elastic material, integrally molded to the ring nut 16", is aligned in the undeformed state with the teat nipple 6" on the central axis 9" of the fastening edge 5". Accordingly, in the undeformed state, the teat 1" has the usual straight alignment, with which many users are familiar.

The nipple carrier 2" has a peripheral groove 29" or relief groove.

Furthermore, a security thread 27" is embedded in the teat 1". This security thread 27" extends from one side of the teat 1" from the upper edge 26" of the ring nut 16" through the nipple carrier 2" and the teat nipple 6" up to the drinking hole 13" and, from the drinking hole 13", to the opposite side of the teat 1" through the teat nipple 6" and the nipple carrier 2" up to the ring nut 16". At both ends, the security thread 27" is connected firmly with the ring nut 16". The security thread 16" consists of a flexible material, so that it participates in the deformations of the teat 1".

In the region of the drinking hole 13", the security thread 27" has an expansion 28" in order to make the required strength available also there.

Preferably, the teat 1", the ring nut 16" and the security thread 27" consist of materials, which can be melted or cross-linked with one another in the contact regions. According to FIG. 6, the security thread 27" is cross-linked on the outside with the inside of the teat 1".

When the covering hood 22" is put in place, the nipple head 7" of this construction slides at the inwardly curved bottom 25" into the edge region, so that the side surface 11" with the drinking hole 13" contacts the side wall 23" of the covering cap 22" with the formation of a seal. The swiveling of the teat nipple 6" with respect to the central axis 9" is facilitated by the grove 29".

This completes the description of the preferred and alternate embodiments of the invention. Those skilled in the art may recognize other equivalents to the specific embodiment described herein which equivalents are intended to be encompassed by the claims attached hereto.

The invention claimed is:

1. A feeding bottle, especially for feeding infants and small children, comprising a bottle, which has an opening and an external thread surrounding the opening, a teat (1), which has a nipple carrier (2) with a fastening edge (5) having a central axis and, on the nipple carrier (2), a teat nipple (6) which is aligned at an acute angle to a central axis (9) of the fastening edge (5), and a drinking hole (13) in a first side surface (11) of the teat nipple, a ring nut (16), which has an internal thread (18) for screwing onto the external thread and means for connecting with the fastening edge (5) of the teat (1), in order to keep the teat (1) from the bottle opening, and a covering cap (22), having a bottom and a side wall which can be placed on the teat (1) and, in this position, presses with the inside of its side wall (23) against the first side surface (11) of the teat nipple (6) and forms a seal and, with the inside of its bottom (25), presses against a second side surface of the teat nipple opposite to the first side surface (11) of the teat nipple (6).

2. The bottle of claim 1, for which the teat nipple (6), at the side surface (11) having the drinking hole (13), is arched outward with a relatively large or small radius of curvature and/or, at the opposite side surface (12), is approximately flat or arched concavely with a relatively large radius of curvature and has a relatively small transition radius in between.

3. The feeding bottle claim 1, for which the drinking hole (13) is disposed in the side surface (11) of the teat nipple (6) facing away from the central axis (9) of the fastening edge.

4. The feeding bottle of claim 1, for which the covering cap (22) has a conical side wall (23) and/or a cup-shaped bottom (25).

5. The feeding bottle of claim 1, for which the ring nut (16) and the covering cap (22) have interacting locking elements (21, 24) for locking the covering cap (22) to the ring nut (16).

6. The feeding bottle of claim 1, for which the axis of the drinking hole (13) is aligned approximately perpendicularly to the side wall (23) of the covering cap (22).

7. The feeding bottle of claim 1, for which the side surface (11) having the drinking hole, has a smaller radius of curvature than the contacting inner side of the side wall (23) and/or the opposite side surface (12) has a larger radius of curvature than the inside of the bottom (25) pressing against it.

8. The feeding bottle of claim 1, for which the nipple carrier (2) has a groove (29), which runs around the central axis (9).

9. The feeding bottle of claim 1, for which the teat (1) has an integrated security thread (27), which extends from the fastening edge (5) to the free end of the teat nipple (6).

10. The feeding bottle of claim 9, for which the security thread (27) extends from the fastening edge (5) to the drinking hole (13).

11. The feeding bottle of claim 1, for which the ring nut (16) has a annular flange (19), which protrudes inward for pressing the fastening edge (5) against an edge of the opening of the bottle, and a central insertion opening (20) for inserting the teat nipple (6) and the nipple carrier (2) of the teat (1).

12. The feeding bottle of claim 1, for which the teat (1) is connected firmly to the fastening edge (5) with the ring nut (16).

* * * * *